United States Patent [19]

Usami et al.

[11] Patent Number: 4,875,837

[45] Date of Patent: Oct. 24, 1989

[54] TWO-FLOW-PASSAGE TYPE EXHAUST GAS DRIVEN TURBO-CHARGER

[75] Inventors: Saburo Usami, Hitachi; Kyoichi Uchiyama, Kashiwa; Satoshi Suzuki, Katsuta, all of Japan

[73] Assignee: Hitachi, Ltd., Tokyo, Japan

[21] Appl. No.: 904,401

[22] Filed: Sep. 8, 1986

[30] Foreign Application Priority Data

Sep. 18, 1985 [JP] Japan ..... 60-204258

[51] Int. Cl.[4] ..... F04B 17/00

[52] U.S. Cl. ..... 417/407; 60/602

[58] Field of Search ..... 417/405, 406, 407, 409; 60/602; 415/177, 203, 204

[56] References Cited

U.S. PATENT DOCUMENTS 2,801,043 7/1957 Spotz et al. ..... 415/177

FOREIGN PATENT DOCUMENTS 05809 1/1984 Japan ..... 415/177

580334 11/1977 U.S.S.R. ..... 417/177

*Primary Examiner*—Louis J. Casaregola

*Assistant Examiner*—Timothy S. Thorpe

*Attorney, Agent, or Firm*—Antonelli, Terry & Wands

[57] ABSTRACT

A two-flow-passage type exhaust gas driven turbo-charger, in which a scroll portion in a casing is divided by an annular partition to form two flow passages, the turbo-charger being constructed so that the difference between the temperature of the outer surface of the portion of the casing to which the partition is fixed and that of the partition can be minimized so as to reduce the thermal strain in the partition and thereby prevent thermal fatigue cracks from occurring therein.

11 Claims, 4 Drawing Sheets

TWO-FLOW-PASSAGE TYPE EXHAUST GAS DRIVEN TURBO-CHARGER

BACKGROUND OF THE INVENTION

This invention relates to a two-flow-passage type exhaust gas driven turbo-charger, and, more particularly, to a two-flow-passage type exhaust gas driven turbo-charger suitable for preventing the thermal fatigue destruction of a partition.

A two-flow-passage type exhaust gas driven turbo-charger is used for the purpose of improving the supercharging capability with respect to the low-speed rotation of an engine by utilizing exhaust pulses or narrowing of the flow passages so as to increase the flow rate of a gas. In a turbo-charger of such a construction, a scroll casing is divided radially by a partition including an annular plate, in such a manner that the flow passages are independent of each other in an interior defined by an inner surface of the scroll casing. A radial flow type turbine wheel is provided in the casing, and the supercharging of the engine is affected by a compressor connected to the turbine wheel. A flow passage valve is provided which is closed when the engine has a low rotational speed, to increase the flow rate of the gas due to the narrow passages. While the turbo-charger of this construction is in operation, the temperature of the partition becomes higher than those of other portions thereof due to the high-temperature gas, so that the turbo-charger is compression-plastically deformed. When this turbo-charger is not in operation, the temperatures of all parts thereof become uniform, so that a tensile stress occurs therein. When the turbo-charger is repeatedly operated and stopped, especially, when the starting of the turbo-charger is suddenly started with the exhaust gas having a high temperature, a crack occurs in some cases in the partition due to the thermal fatigue. This thermal strain occurs due to a difference between the temperature of the partition and that of the outer surface of the casing to which the partition is fixed. However, the failure problems due to thermal fatigue failure of the partition have not been realized. The techniques relating to a turbo-charger of aforementioned type is disclosed in, for example, U.S. Pat. No. 3,614,259.

An object of the present invention is to provide a turbo-charger which is capable of preventing the thermal fatigue failure of a partition by minimizing a difference between the temperature of the partition and that of the outer surface of the portion of a casing to which the partition is fixed.

To achieve the above object, the invention provides a two-passage type exhaust gas driven turbo-charger in which the outer surface of the portion of a casing to which a partition is fixed is covered with a heat-insulating material to promote an increase in the temperature of this portion of the casing and thereby minimize temperature differential between the casing and the partition so as to prevent thermal fatigue failure of the partition caused by the thermal strain occurring therein.

In accordance with further features of the present invention a two-passage type exhaust gas driven turbo-charger is provided in which a free end portion of a partition is covered with a heat-insulating material to suppress an increase in the temperature of the free end portion of the partition and thereby minimize the difference between the temperature of the casing and that of the partition so as to prevent the thermal fatigue failure of the partition caused by the thermal strain occurring therein.

In accordance with still further advantageous features of the present invention a two-passage type exhaust gas driven turbo-charger is provided in which a through bore is provided in the portion of a casing to which a partition is fixed to introduce a high-temperature exhaust gas thereinto and thereby minimize the temperature differential between the temperature of the casing and that of the partition, so as to prevent the thermal fatigue failure of the partition caused by the thermal strain occurring therein.

According to the present invention a two-passage type exhaust gas driven turbo-charger is provided in which a thickness of a root portion of a partition is smaller than that of a free end portion thereof to thereby minimize the temperature differential between the temperature of a casing and that of the partition so that the thermal fatigue failure of partition caused by the thermal strain occurring therein can be prevented.

DESCRIPTION OF THE PREFERRED EMBODIMENTS

Figure 1:
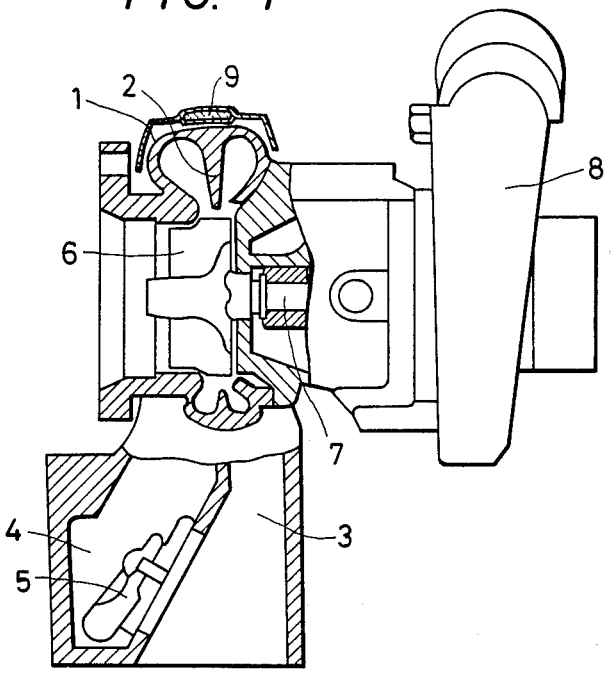
FIG. 1 is a partial cross-sectional cutaway view of a two-passage type exhaust gas driven turbo-charger according to the present invention.
Figure 2:
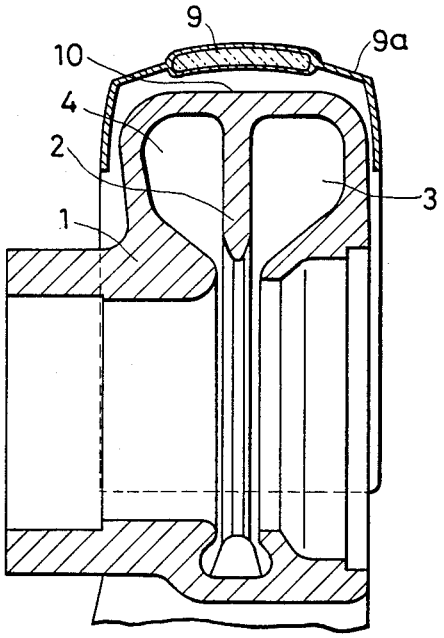
FIG. 2 is a cross-sectional view, on an enlarged scale, of a portion of the turbo-charger of FIG. 1.

Referring now to the drawings wherein like reference numerals are used throughout the various views to designate like parts and, more particular, to FIG. 1, according to this figure, an interior of a turbine casing 1, having a radius of the largest outer-diameter portion of about 130 mm and fashioned, for example, of high nickel austenite cast iron, is divided radially by a partition including an annular plate fixed to the inner surface of a scroll portion of the casing 1. A narrow flow passage 3 and a passage 4, wider than the passage 3, are independent gas passages separated from each other by a partition 2. A valve 5 is provided for opening and closing the narrow flow passage 3 and wide flow passage 4. At a low rotational speed of an engine, the valve 5 is closed to allow a gas to flow only through the narrow flow passage 3, and cause the flow rate of the gas flowing in the same flow passage 3 to increase. The casing 1 is provided therein with a radial flow type turbine wheel 6 adapted to be rotated by a gas flow. A compressor 8 is connected to the turbine wheel 6 via a rotary shaft 7 so as to supercharge an internal combustion engine with a gas such as, for example, air. A heat-insulating material 9 is fixed to the casing 1 so as to extend along the outer surface thereof with a narrow clearance formed between the heat-insulating material 9 and the outer surface of the casing 1. Accordingly, the heat-insulating material 9 prevents the heat from being radiated from the outer surface of the casing 1, and the temperature of the outer surface of the casing 1 from decreasing. As shown in FIG. 2, the heat-insulating material 9 is formed by holding a refractory fiber of 30 mm in width and 4 mm in thickness in an iron plate 9*a*, and fixed to an internal combustion engine so that a narrow clearance is formed between the heat-insulating material 9 and casing 1.

When an internal combustion engine for automobiles is operated with the above-described turbo-charger, until the temperature of an exhaust gas reaches 900° C., the temperature differential between a free end portion of the partition 2 and that of thee outer surface 10 of the portion of the casing 1 to which the partition is fixed is 85° C., this showing that the temperature differential of 85° C. is about ½ of the corresponding temperature differential of 180° C. recorded when the portion of the casing 1 is not covered with the heat-insulating material 9. Moreover, even when operating the engine in this manner and stopping the engine are repeated 104 times, no damage to the partition 2 occurs. On the other hand, when the operating and stopping of the same engine are repeated in the mentioned manner with the casing 1 not covered with the heat-insulating material 9, fine thermal fatigue cracks occur in the outer surface of the partition 2 after the above-mentioned operations of the engine are repeated only two-hundred-thirty times.

Figure 3:
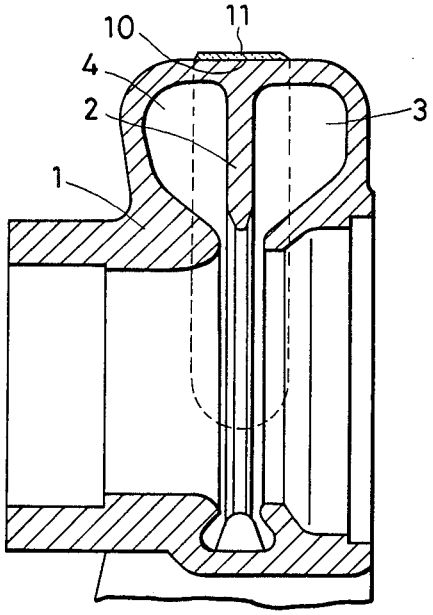
FIG. 3 is a cross-sectional view, on an enlarged scale, of a portion of another embodiment of a turbo-charger of the present invention.

In FIG. 3, ~~a~~ heat-insulating material 11 includes a heat-shielding coating formed by spraying zirconia with low-pressure plasma and forming the same on the outer surface 10 of the portion of a casing 1 to which a partition 2 is fixed so that the heat-insulating material 11 extends from a scroll-starting point on the casing 1 to a 120°-spaced point thereon at which the height of the partition 2 is not more than three times as large as the thickness thereof, and at which the magnitude of thermal strain is small. The width of the heat-insulating material 11 is 20 mm which is three times as large as the thickness of the partition 2, and the thickness thereof 0.3 mm. These sizes are selected so that the temperature of the outer surface 10 does not excessively increase. This embodiment has a simple construction, and is capable of minimizing the thermal strain in the partition.

Figure 4:
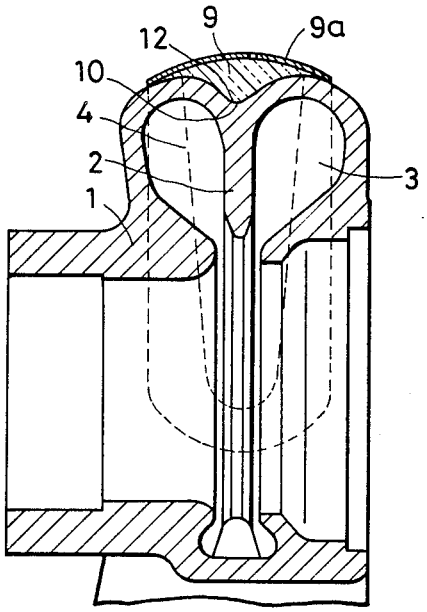
FIG. 4 is a cross-sectional view, on an enlarged scale, of a portion of still another embodiment of a turbo-charger of the present invention.

As shown in FIG. 4, a casing 1 has a heart-shaped cross section from a scroll-starting point thereon to a 120°-spaced point thereon with a recess 12 formed in the outer surface 10 of the portion of the casing 1 to which a partition 2 is fixed. This recess 12 is filled with a heat-insulating material 9 including a refractory fiber, and the outer circumferential surface of the heat-insulating material 9 is held by a convex iron plate 9*a* resistance-welded to the outer surface of the casing 1 and having vent holes therein. In this structure, the temperature of the portion of the casing 1 to which the partition 2 is fixed increases, and the recess 12 can be utilized as a space in which the heat-insulating material is set, thereby making it possible to provide a compact casing 1.

Figure 5:
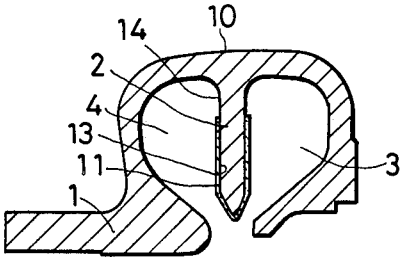
FIG. 5 is cross-sectional view, on an enlarged scale, of a portion of still another embodiment of a turbo-charger according to the present invention.

In FIG. 5, after a casing 1 has been cast, a free end portion 13 of a partition 2 is ground. A root portion 14 of the partition 2 is coated with a fusion-preventing agent including graphite powder. The zirconia powder is then flame-sprayed with plasma on the outer surface of the partition 2 to form a heat-insulating layer 11 having a heat-shielding coating of about 0.3 mm in thickness.

When an internal combustion engine, in which a turbo-charger of the above-described construction is provided, for automobiles is started to introduce a high-temperature exhaust gas into flow passages 3, 4, both side surfaces of the partition 2 contact the high-temperature exhaust gas. However, a sudden increase in the temperature of the partition 2 is prevented since the heat-insulating layer 11 is provided on the free end portion thereof. On the other hand, an increase in the temperatures of the root portion 14 of a large thickness of the partition 2 and the inner surface of the casing 1, which are exposed to the exhaust gas, is promoted. As a result, the difference between the temperature of the free end portion of the partition 2 and that of the outer surface 10 of the portion of the casing 1 to which the partition 2 is fixed becomes small, so that the magnitude of the thermal strain occurring in the partition 2 is small. This can prevent the occurrence of thermal cracks in the partition 2.

Figure 6:
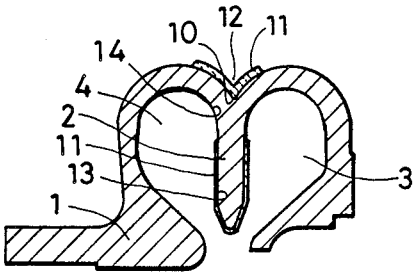
FIG. 6 is a cross-sectional view, on an enlarged scale, of a portion of another embodiment of a turbo-charger of the present invention.

In FIG. 6, a circumferentially-curved recess 12 is formed in an outer surface 10 of the portion of a casing 1 to which a partition is fixed. The outer surface of the recess 12 is covered with a heat-insulating material 2 including a heat-shielding coating which is formed by spraying zirconia powder with plasma on the surface of the recess 12. In the embodiment of FIG. 6, an increase in the temperature of the outer surface 14 of the portion of the casing 1 to which the partition 2 is fixed is promoted, and the magnitude of the thermal strain occurring in the free end portion of the partition 2 further decreases.

In order to obtain a large temperature-unifying effect in the above-described embodiments, it is preferably to set the width of the radially extending exposed surfaces of the root portion 14 of the partition 2 substantially equal to the thickness of the partition 2, and the width of the heat-insulating material 11 on the surface of the recess 12 substantially three times as large as the thickness of the casing.

Figure 7:
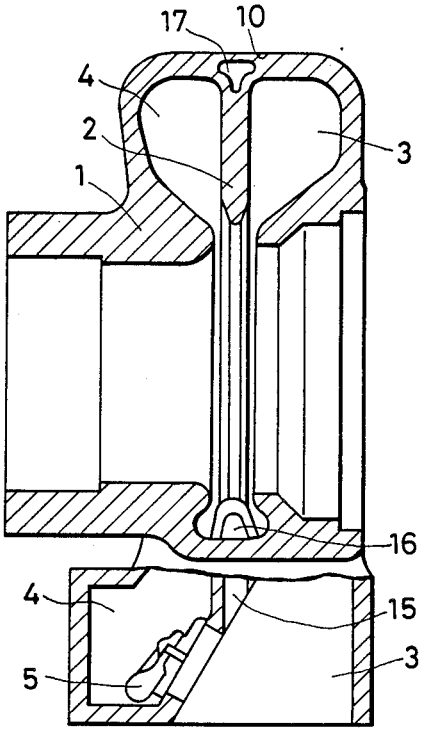
FIG. 7 is a cross-sectional view, on an enlarged scale, of a portion of a still further embodiment of the turbo-charger according to the present invention.

As shown in FIG. 7, in a case of casting a casing 1, a core is set in an intersecting point of the casing 1 and a partition 2 to form a through bore 17, which is opened into a gas inlet portion 15 and a rear portion 16 of a scroll section of the casing 1, in the portion of the casing to which the partition 2 is fixed. After the casing operation has been completed, the core sand is removed from the through bore 17 which is communicated with a flow passage 3 always in communication with an internal combustion engine.

In the embodiment of FIG. 7, a high-temperature exhaust gas flows through the flow passage 3, and flow passage 4 and the through passage 17 to heat the surface which the gas contacts of the casing 1. The through bore 17 is positioned at its whole circumference in the portion of the casing 1 to which the partition 2 is fixed, so that the heating efficiency is high. Namely, the mentioned portion of the casing 1 can be heated by merely introducing an exhaust gas at a low flow rate through a small-diameter flow passage, and the difference between the temperature of the portion of the casing 1 to which the partition 2 is fixed and that of the free end portion of the partition 2 can thus be minimized.

Figure 8:
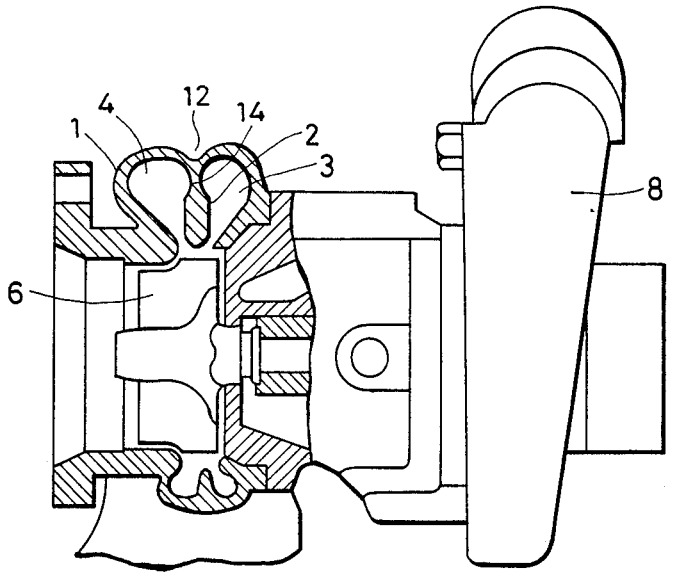
FIG. 8 is a partial cross-sectional view, on an enlarged scale, of a portion of yet another embodiment of the turbo-charger according to the present invention.

In the embodiment of FIG. 8, a root portion 5 of a partition 2 is cut off at both side surfaces thereof so as to reduce the thickness of the portion of the casing 1 which is between a scroll-starting point thereon and an about 180°-spaced point thereon. The portion of the casing 1 to which the partition 2 is fixed is provided with a recess 12, which extends between a scroll-starting point thereon and about 180°-spaced point thereon, to thereby reduce the thickness of the same portion of the casing 1. By such construction, the temperature of a free end portion of the partition 2 increases rapidly when it is heated with an exhaust gas. On the other hand, the root portion 14 and the portion of the casing 1 in the outer surface of which the recess 14 is formed have a small thickness, and, therefore, the temperature of these portions increase substantially as quickly as that of the free end of the partition 2. This enables the occurrence of thermal strain in the partition 2 to be minimized. In the embodiment of this construction, a heat-shielding coating is not required.

In order to make uniform the distribution of temperatures of the free end portion and root portion 14 of the partition 2 during a supercharging operation, it is preferable that the thickness of the region of the root portion 14 and the length of which is within the range substantially corresponding to the thickness thereof be set not more than about ½ of that of the free end portion.

What is claimed is:

1. A two-flow-passage type exhaust gas driven turbocharger comprising:

a turbine casing having a scroll portion into which a high temperature exhaust gas flows;

an annular partition provided in said scroll portion of said turbine casing and extending radially inwardly from a root portion at an inner surface of said scroll portion to a free end portion to radially divide said scroll portion into two parts to thereby form two flow passages for high temperature exhaust gas;

a radial flow type turbine wheel disposed in said turbine casing and driven by a high-temperature exhaust gas introduced therein through said scroll portion;

a compressor connected to said turbine wheel and driven by said turbine wheel so as to supercharge an engine;

an outer surface of a portion of said turbine casing from which said partition extends radially inwardly is covered with a heat-insulating material so that a heat release from the outer surface of said portion of said turbine casing is reduced thereby reducing a temperature differential between said root portion and said free end portion of said partition.

2. A two-flow-passage type exhaust gas driven turbocharger according to claim 1, wherein a recess extending in a circumferential direction of said turbine casing is formed in said outer surface of said portion of said turbine casing from which said partition extends, and wherein said heat-insulating material is disposed in said recess.

3. A two-flow-passage type exhaust gas driven turbocharger according to claim 1, wherein said heat insulating material is held by a plate member surrounding an outer surface of said scroll portion of said turbine casing with a gap therebetween.

4. A two-flow-passage type exhaust gas driven turbocharger according to claim 3, wherein said heat-insulating material is embedded in said plate member.

5. A two-flow-passage type exhaust gas driven turbocharger comprising:

a turbine casing having a scroll portion into which a high temperature exhaust gas flows;

an annular partition provided in said scroll portion of said turbine casing and extending radially inwardly from a root portion at an inner surface of said scroll portion to a free end portion thereof to radially divide said scroll portion into two parts and to form two flow passages for high temperature exhaust gas;

a radial flow type turbine wheel disposed in said turbine casing to be driven by a high-temperature exhaust gas introduced therein through said scroll portion;

a compressor connected to said turbine wheel to be driven by said turbine wheel so as to supercharge an engine;

a heat-shielding layer formed on an outer surface of a portion of said turbine casing from which said partition extends radially inwardly; and a layer of the heat-shielding coating formed on a surface of said free end portion of said partition.

6. A two-flow-passage type exhaust gas driven turbocharger comprising:

a turbine casing having a scroll portion through which a high temperature exhaust gas flows;

a radial flow type turbine wheel provided in said turbine casing and driven by exhaust gas flowing in said scroll portion;

an annular partition provided in said scroll portion and extending radially inwardly from an inner surface of said scroll portion to a position near a peripheral portion of said turbine wheel throughout said scroll portion to thereby divide an interior of said scroll portion into two flow passages which are independent from and are in parallel with each other;

a valve means for opening and closing a communication passage between said two flow passages;

a compressor connected to said turbine wheel by a shaft and driven by said turbine wheel for supercharging an engine;

a plate member provided to surround an outer surface of said scroll portion of said turbine casing with a gap therebetween; and a heat insulating material held by said plate member at a position spaced from and facing an outer surface of said portion of said scroll portion from which said partition extends radially inwardly.

7. A two-flow-passage type exhaust gas driven turbocharger according to claim 8, wherein said turbine casing is made of a casting integrated with said partition.

8. A two-flow-passage type exhaust gas driven turbocharger according to claim 6, wherein said heat-insulating material is embedded in said plate member.

9. A two-flow-passage type exhaust gas driven turbocharger comprising:

a turbine casing having a scroll portion through which a high temperature exhaust gas flows;

a radial flow type turbine wheel provided in said turbine casing and driven by exhaust gas flowing in said scroll portion;

an annular partition provided in said scroll portion and extending radially inwardly from an inner surface of said scroll portion to a position near a peripheral portion of said turbine wheel throughout said scroll portion to thereby divide an interior of said scroll portion into two flow passages which are independent from and are in parallel with each other;

a compressor connected to said turbine wheel by a shaft and driven by said turbine wheel for supercharging an engine; and heat released prevention means surrounding an outer surface of said scroll portion of said turbine casing around a root portion of said angular partition from which said angular partition extends radially inwardly to a free end portion thereof for preventing said root portion for releasing heat to the atmosphere to reduce a temperature difference in said angular partition between said root portion and said free end portion.

10. A two-flow-passage type exhaust gas driven turbo-charger according to claim 9, wherein said heat release prevention means comprises:

a plate member provided to surround said outer surface of said scroll portion of said turbine casing with a gap therebetween; and a heat insulating material held by said plate member at a position spaced from and facing an outer surface of said portion of said scroll portion from which said partition extends radially inwardly.

11. A two-flow-passage type exhaust gas driven turbo-charger according to claim 10, wherein said heat-insulating material is embedded in said plate member.

* * * * *